US006736659B1

(12) United States Patent
Wu

(10) Patent No.: US 6,736,659 B1
(45) Date of Patent: May 18, 2004

(54) CABLE CONNECTOR ASSEMBLY

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/671,117

(22) Filed: Sep. 24, 2003

(51) Int. Cl.[7] ..... H01R 13/74
(52) U.S. Cl. ..... 439/247; 439/573
(58) Field of Search ..... 439/247, 248, 439/573

(56) References Cited

U.S. PATENT DOCUMENTS

| | | | | |
|---|---|---|---|---|
| 4,647,130 A | | 3/1987 | Blair et al. | |
| 4,915,641 A | | 4/1990 | Miskin et al. | |
| 5,199,900 A | | 4/1993 | Hayes, Sr. | |
| 5,228,865 A | * | 7/1993 | Douty et al. | 439/247 |
| 5,356,300 A | | 10/1994 | Costello et al. | |
| 5,466,171 A | | 11/1995 | Bixler et al. | |
| 5,514,000 A | | 5/1996 | Krause et al. | |
| 5,547,385 A | | 8/1996 | Spangler | |
| 5,752,845 A | * | 5/1998 | Fu | 439/247 |
| 5,766,041 A | | 6/1998 | Morin et al. | |
| 5,772,471 A | | 6/1998 | Buck | |
| 5,795,177 A | * | 8/1998 | Hirono | 439/378 |
| 6,234,817 B1 | | 5/2001 | Hwang | |
| 6,290,536 B1 | | 9/2001 | Hwang et al. | |

* cited by examiner

*Primary Examiner*—Gary F. Paumen
(74) *Attorney, Agent, or Firm*—Wei Te Chung

(57) ABSTRACT

A cable connector assembly (8) includes an insulative housing (1), a number of contacts (6) received in the housing, a cable (4) electrically connecting with the contacts, a cover (2) cooperating with the housing to sandwich the cable therebetween, and a pair of fastening members (5). The housing includes a base (10) and a mating portion (11) projecting outwardly from the base. The base forms a pair of ear portions (12) disposed at opposite ends thereof and extending vertically from an upper surface (100) thereof, and a pair of spring arms (108) formed on a lower surface (106) thereof, and a pair of guiding members (13) extending outwardly therefrom. Each guiding member forms a protrusion (132) on the lower surface for preventing the cable connector assembly moving away from a panel on which the assembly is mounted.

3 Claims, 11 Drawing Sheets

CABLE CONNECTOR ASSEMBLY

BACKGROUND OF THE INVENTION

1. Field of the Invention

The present invention generally relates to a cable connector assembly, and more particularly to a floatable cable connector assembly.

2. Description of Related Art

Cable connector assemblies are widely used for signal or power transmission between personal computers and peripheral equipments. Such a cable connector assembly is usually needed to be float-mounted to a panel on which a plurality of connectors are arranged side by side to form a sub module. U.S. Pat. Nos. 4,647,130 and 4,915,641 each disclose such an assembly.

The connector assembly disclosed in U.S. Pat. No. 4,647,130 comprises matable plug and receptacle connectors. The plug connector comprises a pair of flanges diagonally formed at opposite ends of a base thereof and a pair of guide pins disposed at opposite ends of the base and diagonally across from each other. Each flange defines a mounting hole therein and a pair of arcuate projections are located at a substantial angle from the major axis of the plug connector and are around a corresponding mounting hole. A pair of elastomeric ring-like members are secured around a respective pair of projections, thus becoming elongated. A pair of shoulder screws respectively protrude through the mounting holes and the elastomeric ring-like members to tightly engage with the panel. However, this design is relatively complex in structure and the manufacturing cost is relatively high.

U.S. Pat. No. 4,915,641 discloses a pair of matable female and male connectors each being mounted to a panel. The female connector comprises a planar mounting flange having mounting apertures therethrough for mounting the assembly to a panel. The male connector comprises a pair of flanges on opposite ends thereof and each flange defines a mounting aperture and a mounting collar therethrough to enable the float mounting of the male connector to an appropriate panel. The collar is a hollow generally cylindrical collar having an aperture dimensioned to receive a bolt, rivet or other connecting means. However, the flanges of the male and the female connectors occupy a relatively big space and the dimension of the male or the female connectors in a longitudinal direction thereof is thus increased.

Hence, an improved floatable cable connector assembly is highly desired to overcome the disadvantages of the prior art.

SUMMARY OF THE INVENTION

Accordingly, an object of the present invention is to provide a cable connector assembly with a minimized transverse size.

Another object of the present invention is to provide a suspensory panel mount cable connector assembly.

In order to achieve the object set forth, a cable connector assembly in accordance with the present invention comprises an insulative housing, a plurality of conductive contacts received in the housing, a cable comprising a plurality of conductors electrically connected with the contacts, a cover cooperating with the housing to sandwich the cable between the cover and the housing, and a pair of fastening members for securing the cable connector assembly to a panel. The housing comprises a base and a mating portion projecting outwardly from the base. The base comprises an upper surface and an opposite lower surface. The base forms a pair of ear portions disposed at opposite ends thereof and extending vertically from the upper surface thereof, a pair of spring arms formed on the lower surface thereof. A pair of guiding members extend outwardly from the base and are spaced by the mating portion. Each guiding member forms a protrusion extending away from a corresponding ear portion.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
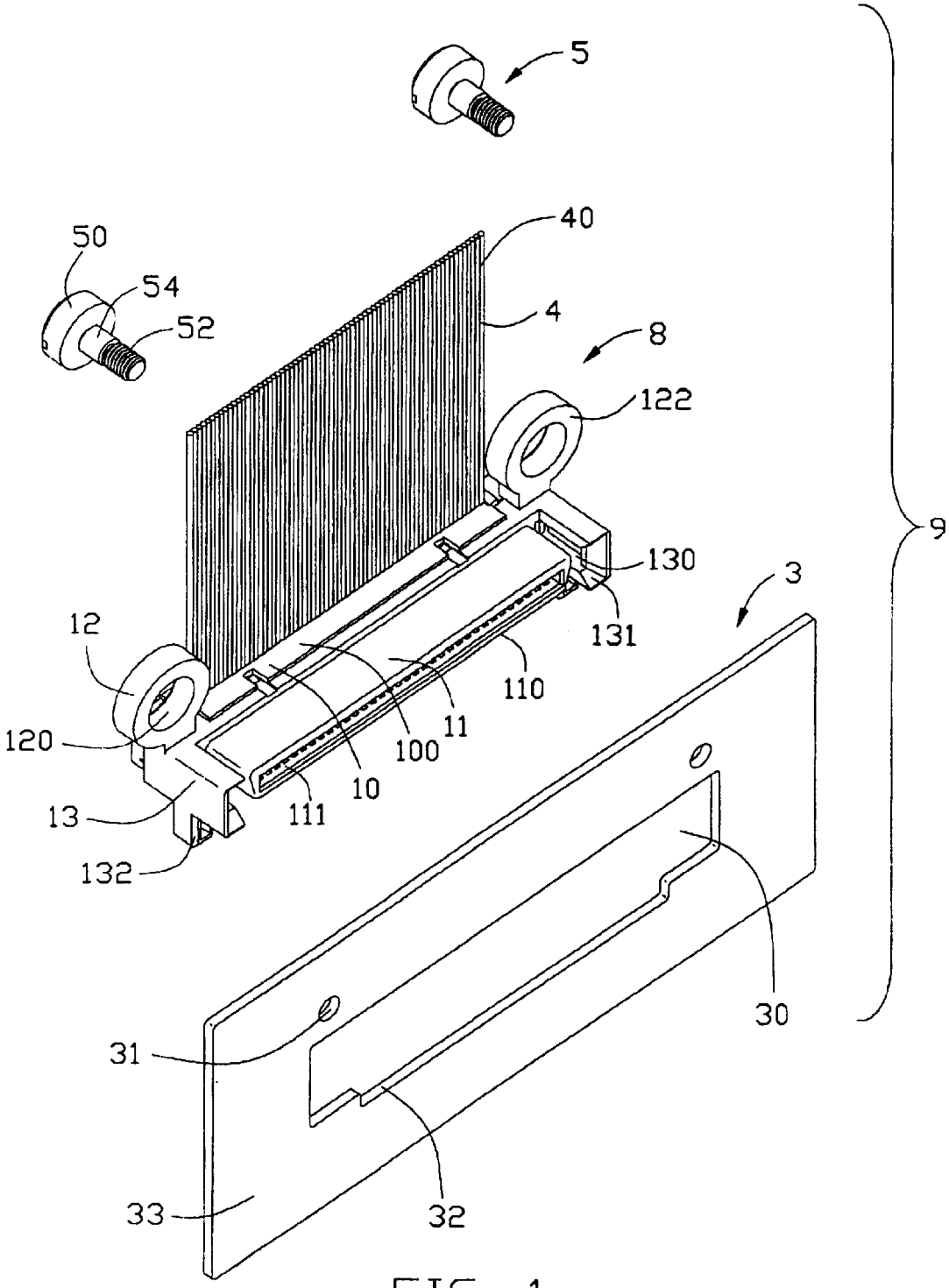
FIG. 1 is a partially exploded, perspective view of a cable connector assembly in accordance with the present invention.
Figure 2:
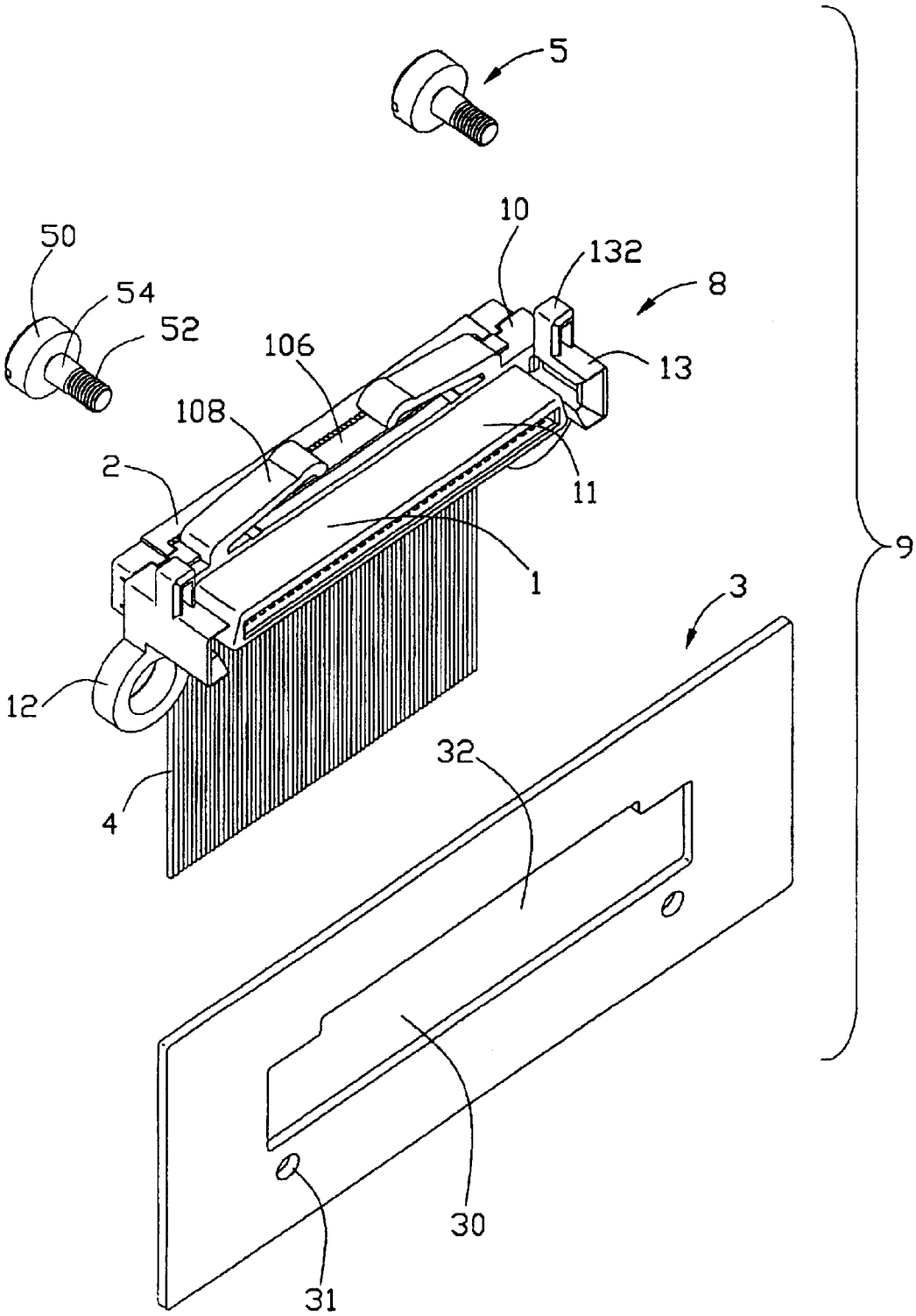
FIG. 2 is a view similar to FIG. 1, but taken from a different aspect.
Figure 6:
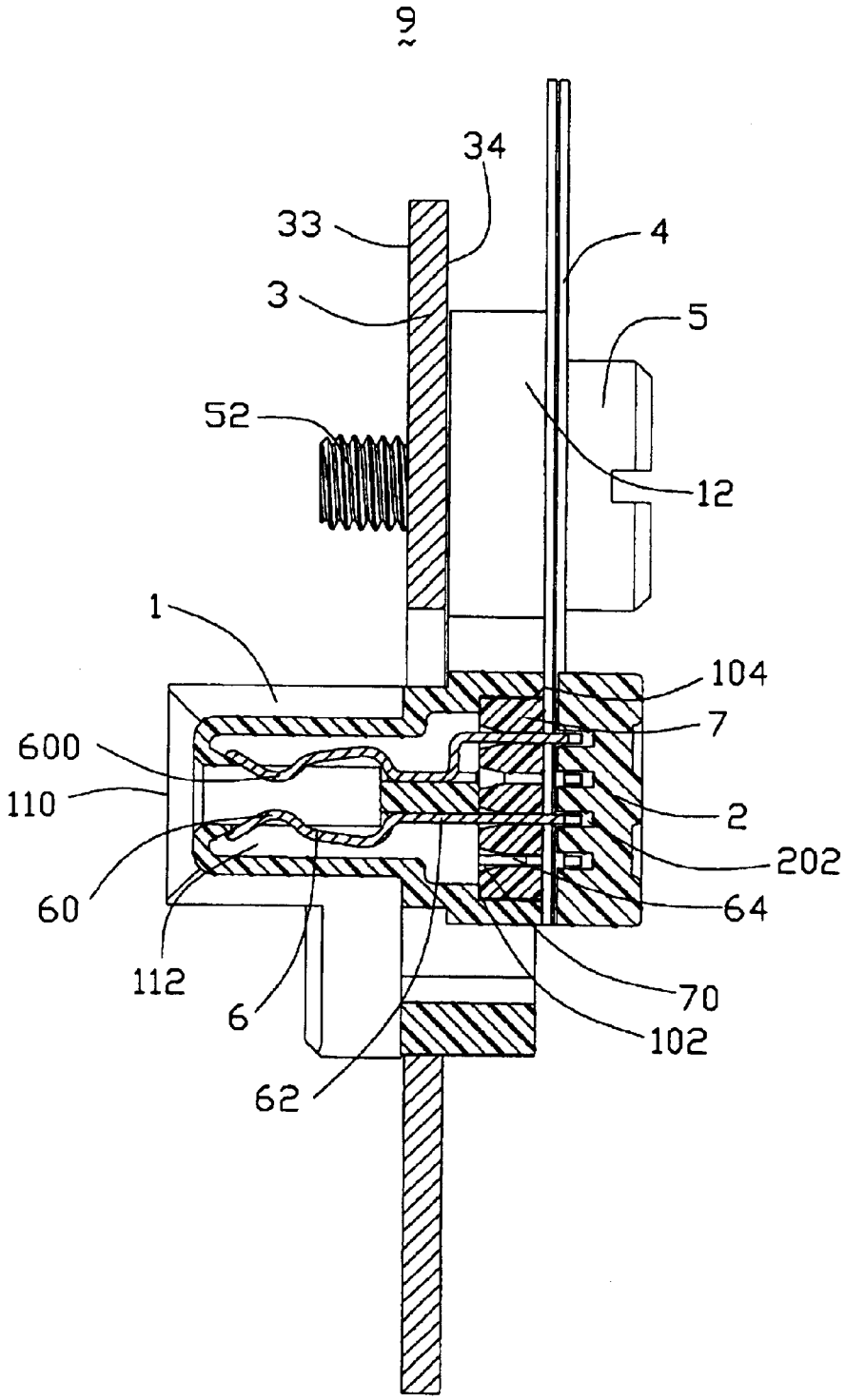
FIG. 6 is a cross-sectional view of the cable connector assembly of FIG. 4 taken along line 6—6.
Figure 7:
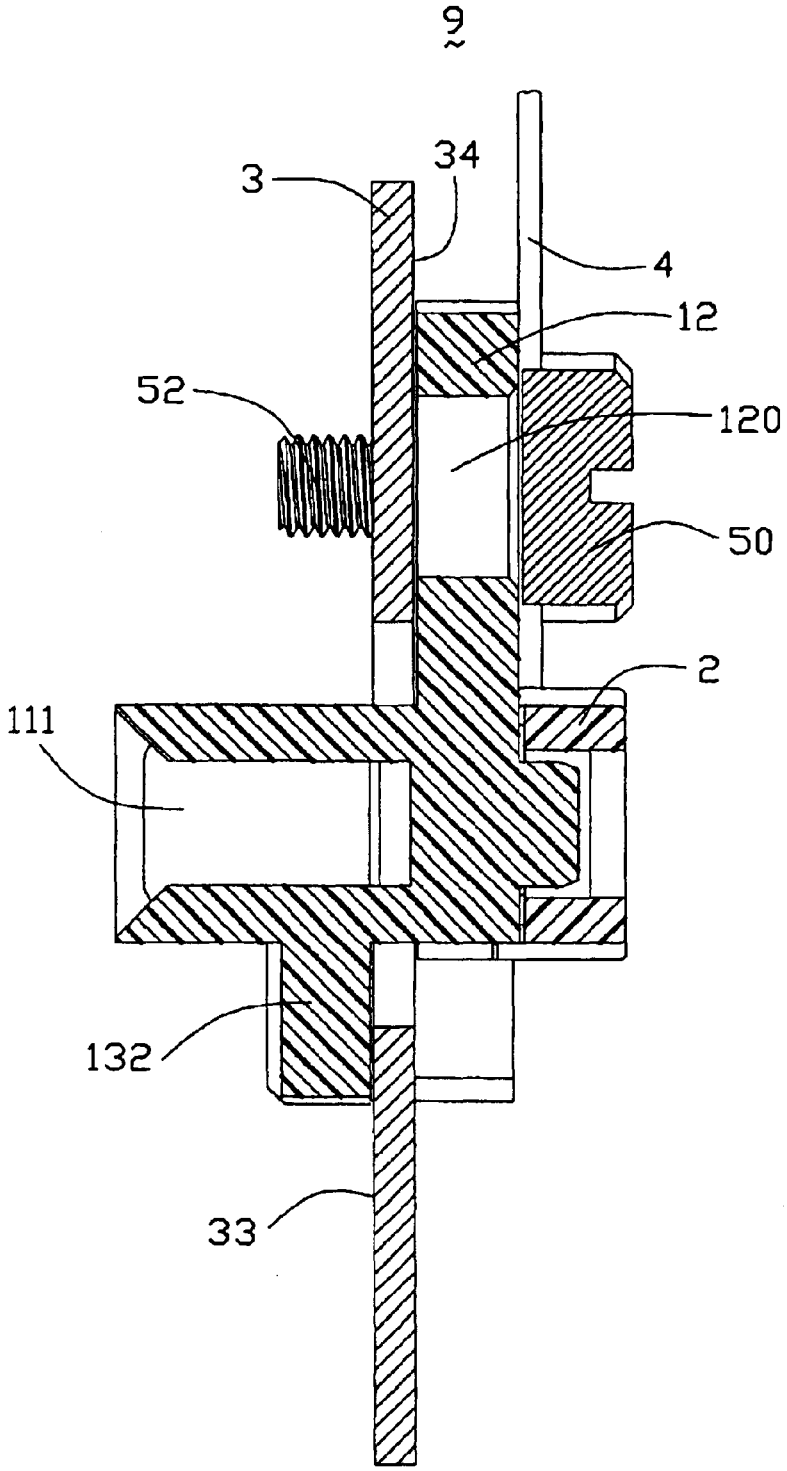
FIG. 7 is a cross-sectional view of the cable connector assembly of FIG. 4 taken along line 7—7.
Figure 8:
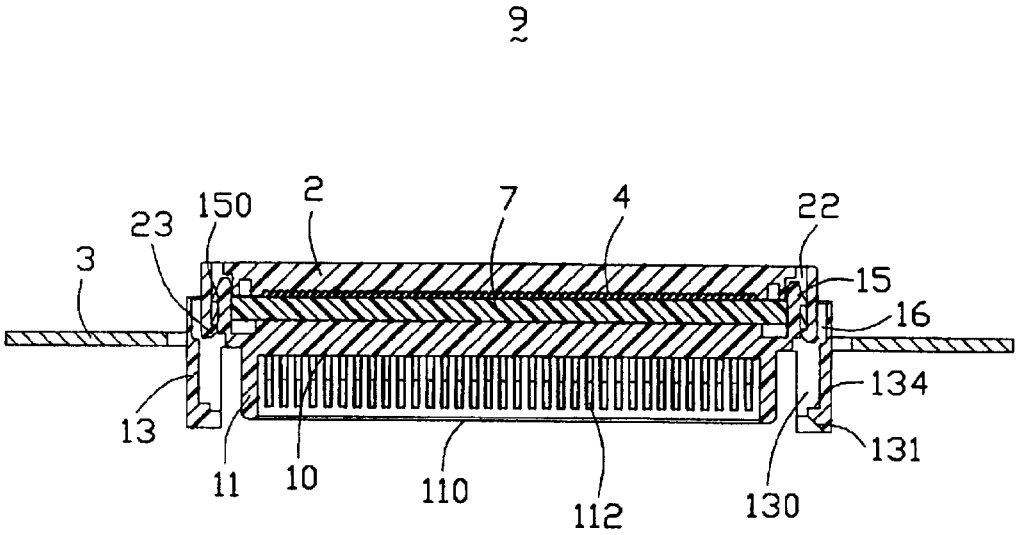
FIG. 8 is a cross-sectional view of the cable connector assembly of FIG. 4 taken along line 8—8.

Referring to FIG. 1 and FIG. 2 in conjunction with FIGS. 6–8, a cable connector assembly 8 in accordance with the present invention, which is mounted to a panel 3 to form a system 9, comprises an insulative housing 1, a plurality of conductive contacts 6 assembled to the insulative housing 1, a flat cable 4 electrically connected with the conductive contacts 6, a cover 2 assembled to the insulative housing 1, a pair of fastening members 5 and a spacer 7 assembled to the insulative housing 1.

The insulative housing 1 is substantially elongated and comprises a base 10 and a mating portion 11 protruding outwardly from a center of the base 10. The insulative housing 1 comprises a mating face 110 and an opposite terminating face 104 (referring to FIG. 6). The insulative housing 1 also defines a mating direction and a longitudinal direction perpendicular to the mating direction.

The base 10 comprises an upper surface 100 and an opposite lower surface 106. A pair of ear portions 12 are disposed at opposite ends of the base 10 and extend vertically from the upper surface 100 along a direction perpendicular to both the mating direction and the longitudinal direction of the housing 1. Each ear portion 12 comprises a first face 122 and an opposite second face 124. A mounting aperture 120 extends from the first face 122 to the second face 124 of the ear portion 12. The second face 124 is coplanar with the terminating face 104 of the insulative housing 1. A pair of spring arms 108 are disposed on the lower surface 106 of the base 10 and extend toward each other along the longitudinal direction. A pair of guiding members 13 protrude outwardly from the base 10 adjacent to the mating portion 11 and beyond the mating face 110. Each guiding member 13 is chamfered to form a lead-in surface 130. Particularly referring to FIG. 8, a U-shaped receiving cavity 132 is formed in each guiding member 13, thus forming a latch section 134. Each guiding member 13 is formed with a protrusion 132 extending vertically therefrom and located adjacent to respective spring arms 108.

The mating portion 11 is substantially D-shaped and defines a receiving space 111 recessed toward the terminating face 104 from the mating face 110. A cavity 102 (FIG. 6) is defined in the terminating face 104. Particularly referring to FIGS. 6 and 8, a plurality of passages 112 are defined in opposite longitudinal inner faces of the mating portion 11 and communicate with the cavity 102 and the receiving space 111. A pair of slits 16 are respectively defined through the base 10 and respectively communicate with the receiving cavities 130 of the guiding members 13. A pair of retaining portions 15 extend beyond the terminating face 104 and each is provided with a pair of wedges 150.

The spacer 7 is elongated and is made of insulative material. A plurality of passageways 70 (FIG. 6) is defined through the spacer 7 corresponding to the passages 112.

Referring to FIGS. 1–2 in conjunction with FIG. 6 and FIG. 8, the cover 2 is made of insulative material and comprises a main body 20 and a pair of lateral ends 21. The main body 20 defines a plurality of grooves 202 (FIG. 6) in a front surface thereof. Each lateral end 21 defines a channel 22 therethrough and forms a latch 23 extending outwardly therefrom.

Referring to FIG. 1, in the preferred embodiment, the cable 4 is a flat ribbon cable and comprises a plurality of insulated conductors 40.

Referring to FIG. 6 and FIG. 8, each conductive contact 6 comprises a retention section 62, a mating section 60 extending from one end of the retention section 62 with a curved mating end 600, and a tail section 64 extending from the other end of the retention section 62.

Figure 3:
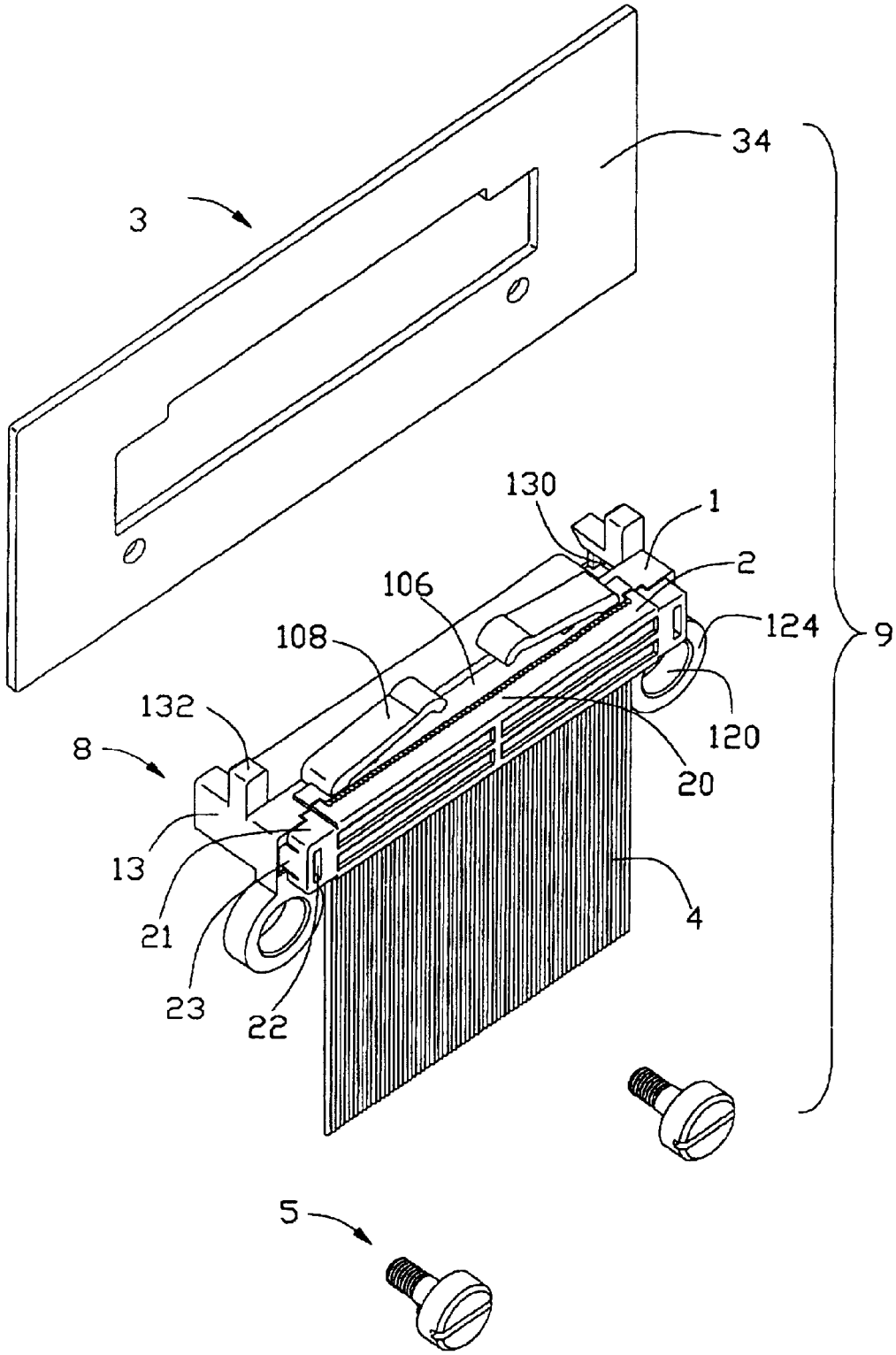
FIG. 3 is a view similar to FIG. 1, but taken from a different aspect.
Figure 4:
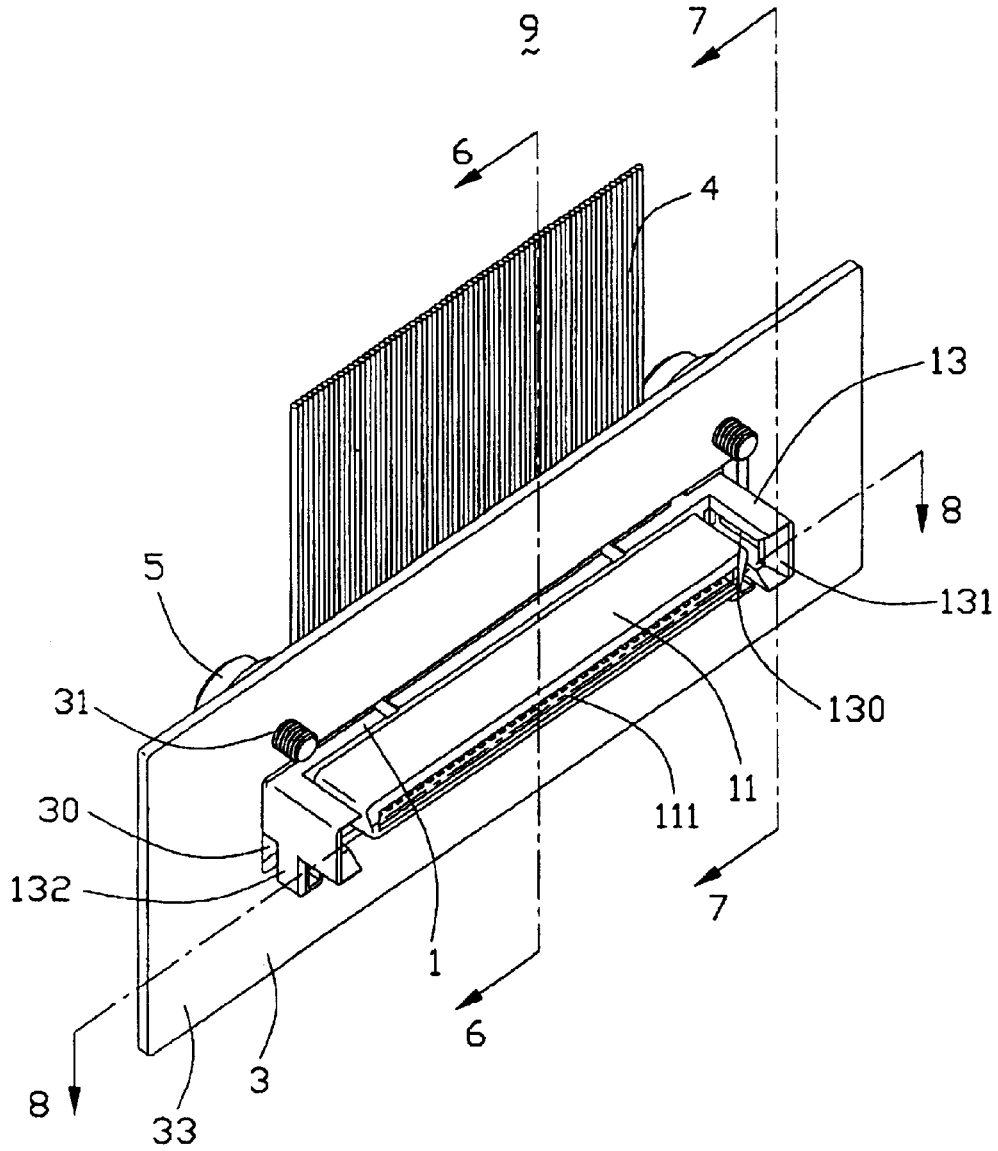
FIG. 4 is an assembled view of FIG. 1.
Figure 5:
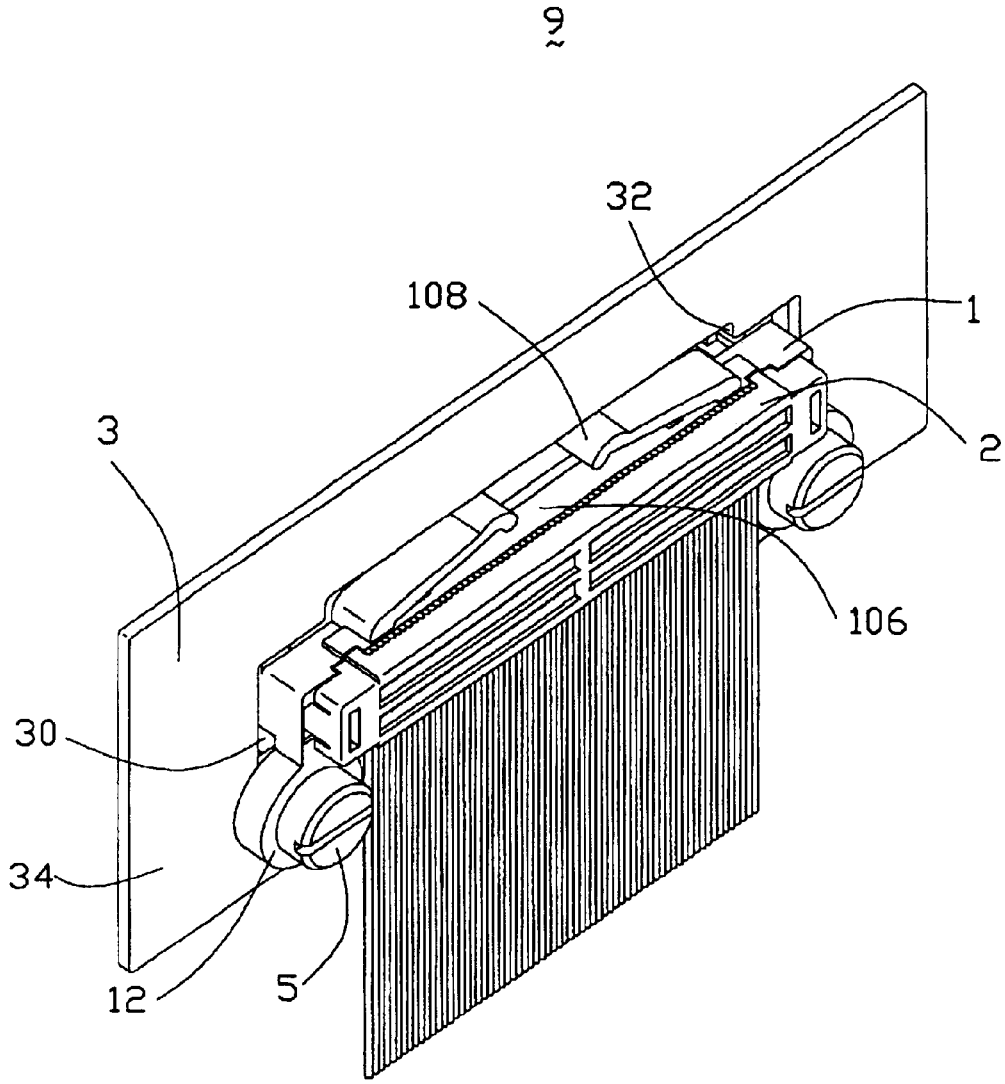
FIG. 5 is a view similar To FIG. 4, but taken from a different aspect.

Referring to FIGS. 1–3, each fastening member 5 is a jackscrew and comprises an enlarged operating portion 50, a threaded portion 52 and a medial portion 54 interconnecting the operating portion 50 with the threaded portion 52.

Referring to FIGS. 1–3, the panel 3 is a rectangular board and defines a mounting opening 30 in a center thereof and a pair of mounting holes 31 located above the mounting opening 30 corresponding to the pair of fastening members 5. A rectangular polarizing opening 32 are recessed from a lower edge of the mounting opening 30 corresponding to the pair of spring arms 108.

In assembly of the cable connector assembly 8, referring to FIGS. 1–5 in conjunction with FIGS. 6–8, the conductive contacts 6 are respectively inserted into the passages 112 with the curved mating ends 600 of the mating sections 60 exposed into the receiving space 111. The retention sections 62 interfere fit into corresponding passages 112 for securing the conductive contacts 6 to the insulative housing 1. The spacer 7 is assembled to the insulative housing 1 and is received in the cavity 102. The tail sections 64 protrude through corresponding passageways 70 of the spacer 7 and extend beyond the terminating face 104 of the insulative housing 1. The insulated conductors 40 of the cable 4 are respectively insulation displacement connected with the tail sections 64 to form an electrical connection therebetween.

The insulative cover 2 is assembled to a rear of the insulative housing 1. The pair of latches 23 and the pair of retaining portions 15 are respectively received in the slits 16 of the housing 1 and the channels 22 of the cover 2 to thereby latch with each other. Thus, the cover 2 is securely attached to the insulative housing 1.

Particularly referring to FIGS. 4–7, the pair of fastening members 5 respectively protrude through the pair of mounting apertures 120 of the ear portions 12. The operating portion 50 is exposed beyond the second face 124 of the ear portion 12. The medial portion 54 is received in the mounting aperture 120, and the threaded portion 52 is exposed beyond the first face 122 of the ear portion 12.

Referring to FIGS. 1–5 in conjunction with FIGS. 6–8, when the cable connector assembly 8 is assembled to the panel 3, the mating portion 11 and the pair of guiding members 13 extend through the mounting opening 30 until a rear face 34 of the panel 3 abuts against the first faces 122 of the ear portions 12 and an opposite front face 33 of the panel 3 abuts against the protrusions 132. The pair of spring arms 108 are received in the polarizing opening 32. The threaded portions 52 of the fastening member 5 respectively protrude through the mounting holes 31. To secure the cable connector assembly 8 to the panel 3, an operator needs to screw a locking nut (not shown) to the threaded portion 52 of the fastening member 5. Therefore, the cable connector assembly 8 is assembled to the panel 3 in a suspensory manner. Particularly referring to FIGS. 6 and 7, when mating with a complementary connector, the cable connector assembly 8 tends to rotate around the fastening members 5. Since the protrusions 132 engage with the front face 33 of the panel 3, the cable connector assembly 8 has no possibility of rotating.

Figure 9:
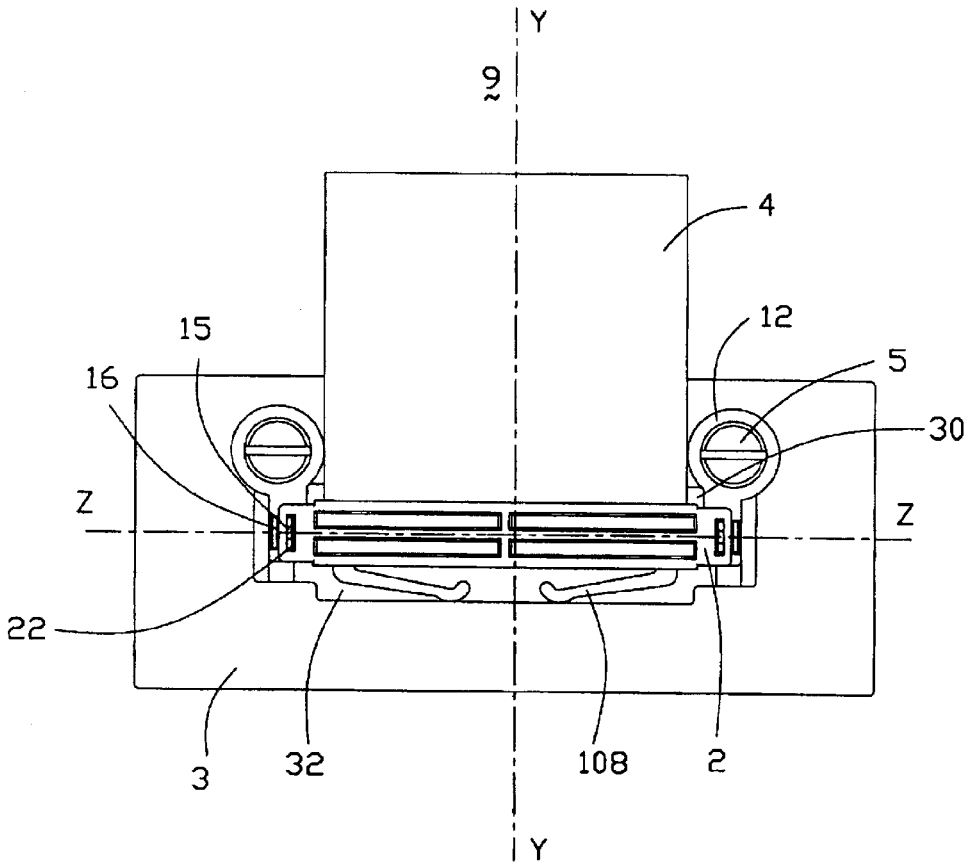
FIG. 9 is a rear elevational view of FIG. 4.
Figure 10:
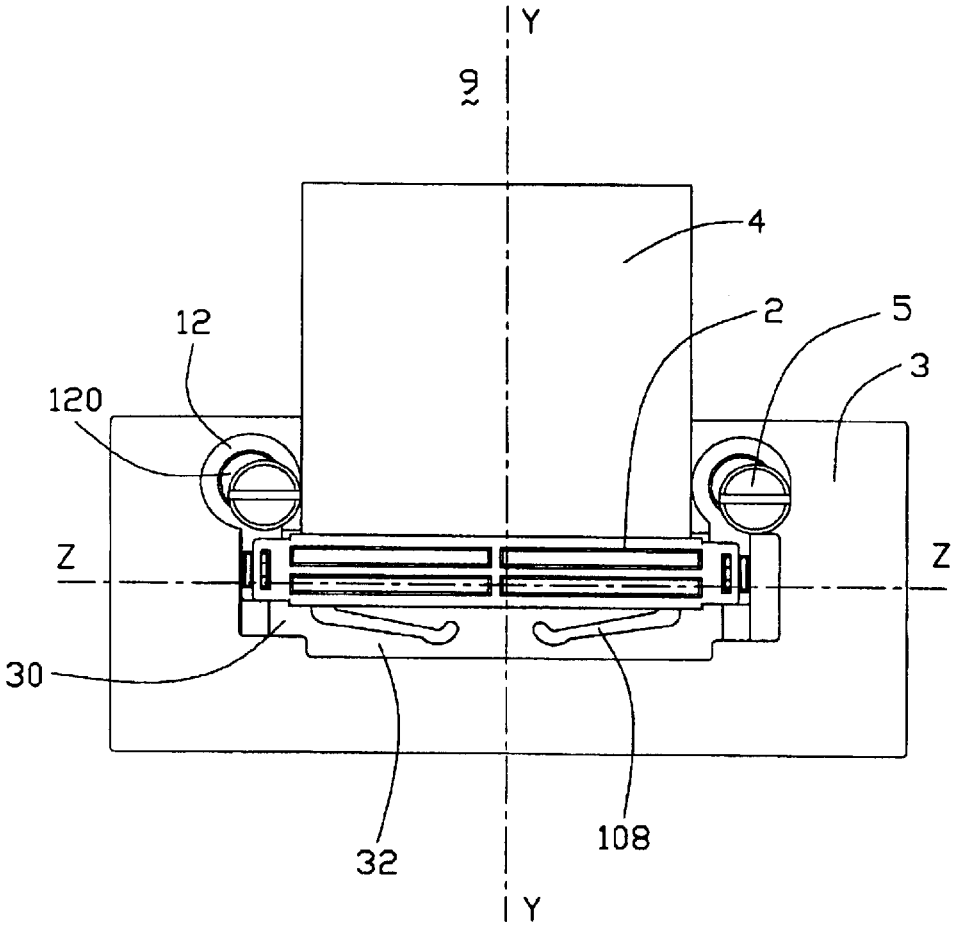
FIG. 10 is a view illustrating a mating status of the cable connector assembly in accordance with the present invention.
Figure 11:
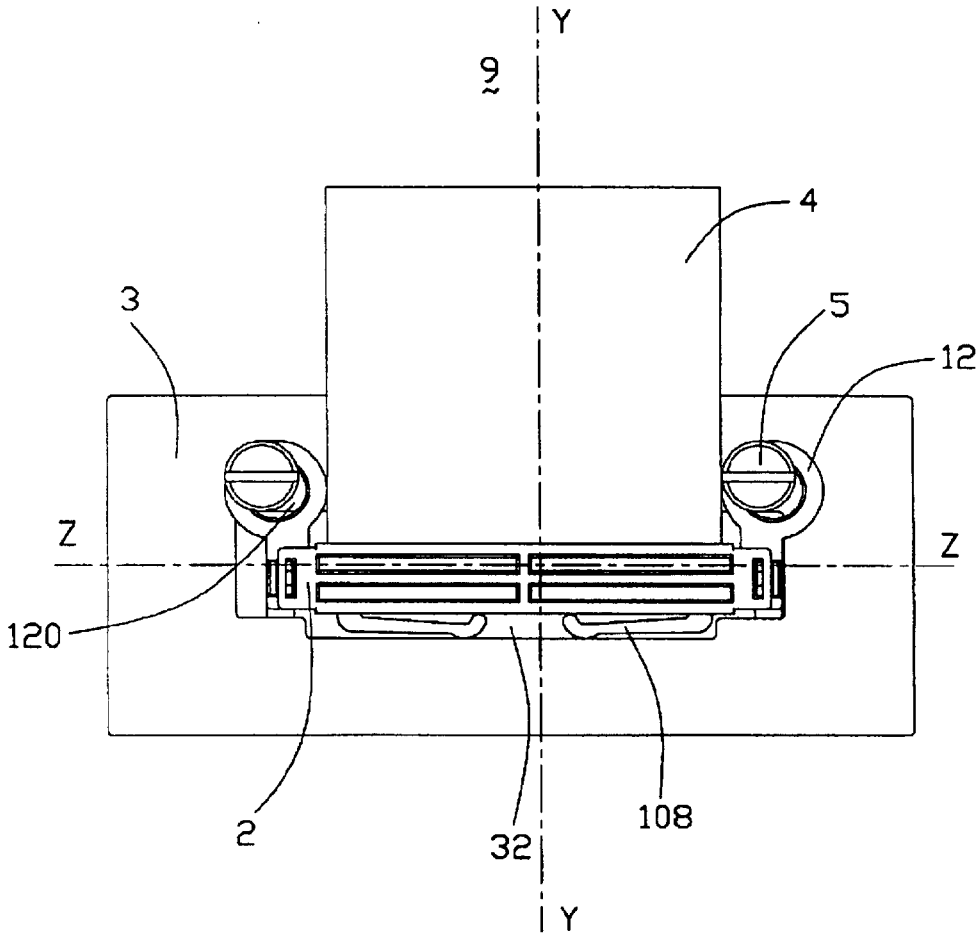
FIG. 11 is a view illustrating another mating status of the cable connector assembly.

Particularly referring to FIG. 9, the panel 3 defines axis Z along the longitudinal direction of the insulative housing 1 and axis Y perpendicular to axis Z. Before mating with the complementary connector, the cable connector assembly 8 is located in a center relative to axis Z and axis Y, that is the gravity of the cable connector assembly 8 is equal to the supporting force exerted by the spring arms 108. FIGS. 10–11 show different instances of the cable connector assembly 8 being mated with the complementary connector. Referring to FIG. 10, the cable connector assembly 8 is floated to a top, left position relative to axis Z and axis Y. Referring to FIG. 11, the cable connector assembly 8 is floated to a bottom, right position relative to axis Z and axis Y. However, after unmating, the cable connector assembly 8 automatically returns to the central position shown in FIG. 9 as functioned by the spring arms 108.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the fastener member 5 may be replaced by a post integrally extending from the insulative housing, and the mounting hole 31 in the panel 3 is enlarged to be larger than the diameter of such a post so as to allow the post to not only extend therethrough but also be radially moved therein relative to the panel 3 under a condition that either a cap is attached to the distal end of the post or the distal end of the post is riveted/enlarged both for preventing the backward movement of the post and the associated connector housing relative to the panel thus assuring the connector is constantly associated with the panel while in a recoverably floating manner along a plane defined by the panel.

What is claimed is:

1. A cable connector assembly adapted for being mounted to a panel, comprising:

an insulative housing defining a mating direction and a longitudinal direction perpendicular to the mating direction and comprising a base and a mating portion projecting outwardly from the base along the mating direction, the base comprising an upper surface and a lower surface both extending along said longitudinal direction, a pair of ear portions disposed at opposite ends thereof and extending vertically from the upper surface, and a pair of spring arms formed on the lower surface;

a plurality of conductive contacts received in the insulative housing;

a cable comprising a plurality of conductors respectively electrically connecting with the conductive contacts; and a pair of fastening members protruding through the ear portions of the insulative housing for securing to the panel;

wherein the pair of spring arms extend toward each other along said longitudinal direction;

wherein the base forms a pair of guiding members at opposite sides of the mating portion;

wherein each guiding member forms a protrusion extending along a direction away from a corresponding ear portion;

wherein the guiding member forms a U-shaped receiving cavity;

wherein the guiding member is chamfered to form a lead-in surface;

further comprising a spacer, and wherein the insulative housing comprises a mating face and a terminating face opposite to the mating face and defines a cavity recessed from the terminating face toward the mating face to receive the spacer;

wherein the insulative housing defines a plurality of passages to receive the conductive contacts, wherein the spacer defines a plurality of passageways corresponding to the passages, and wherein each conductive contact comprises a tail section respectively protruding through the passageway of the spacer and extending beyond the terminating face;

wherein the housing defines a receiving space recessed from the mating face toward the terminating face and communicating with the passages, and wherein each conductive contact comprises a mating section opposite to the tail section and forming a curved mating end exposed in the receiving space;

further comprising a cover, wherein the insulative housing forms a retaining portion extending beyond the terminating face thereof and a slit beside the retaining portion, and wherein the insulative cover forms a latch received in the slit and latching with the retaining portion;

whrein the slit communicates wit the receiving cavity of the guiding member;

wherein the cable is sandwiched between the insulative housing and the cover;

wherein the mating portion is D-shaped;

wherein the ear portion comprises a first face and a second face opposite to the first face, and each fastening member comprises an enlarged operating portion exposed beyond the second face of the ear portion, a threaded portion exposed beyond the first face of the ear portion and a medial portion interconnecting the operating portion and the threaded portion.

2. An electrical system comprising:

a panel defining a mounting opening, a pair of mounting holes and a polarizing opening recessed from a lower edge of the mounting opening, the panel comprising a front face and an opposite rear face; and a cable connector assembly comprising:

an insulative housing defining a mating direction and a longitudinal direction perpendicular to the mating direction and comprising a base and a mating portion projecting outwardly from the base along the mating direction and through the mounting opening of the panel, the insulative housing comprising an upper surface and an opposite lower surface both extending along said longitudinal direction, the base comprising a pair of ear portions disposed at opposite ends thereof and extending vertically from the upper surface, the housing forming a pair of protrusions on the lower surface thereof adjacent to the mating portion, the rear face of the panel abutting against the ear portions and the front face of the panel abutting against the protrusions;

a plurality of conductive contacts received in the insulative housing;

a cable comprising a plurality of conductors respectively electrically connecting with the conductive contacts; and a pair of fastening members respectively protruding through the ear portions and the mounting holes of the panel to secure the cable connector assembly to the panel;

wherein the insulative housing forms a pair of spring arms opposite to the ear portions and extending toward each other along said longitudinal direction, said spring arms abutting against an edge of the polarizing opening when the cable connector assembly is mounted on said panel;

wherein the base of the cable connector assembly further defines a pair of guiding members extending outwardly therefrom and spaced by the mating portion, wherein the protrusions are respectively formed on the guiding members.

3. An electrical connector system comprising:

a panel forming a large mounting opening defining lengthwise and transverse directions perpendicular to each other, and a pair of small mounting holes by two sides of the mounting opening;

a cable connector assembly comprising:

an insulative housing including a mating portion extending through said large mounting opening, and a pair of mounting ears located around two opposite ends of the housing and in alignment with the corresponding small mounting ears;

a plurality of contacts disposed in the housing;

a pair of fastener means forwardly extending around the pair of mounting ears and attached to the panel around said two mounting holes, respectively, under a condition that the fastener means cooperates with the panel to restrict movement of the connector relative to the panel in a front-to-back direction while allowing floating movement of the connector relative to the panel in at least one of said lengthwise and said transverse directions; wherein said housing further includes a recovery device engageable with a periphery of said large mounting opening to counterbalance another external force imposed upon the connector in at least one of the lengthwise direction and the transverse direction;

wherein said fastener means is a screw having a diameter smaller than a diameter of a hole in the corresponding mounting ear and with an enlarged head abutting against a rear face of the corresponding mountingt ear and with threads latchably threaded to threads in the corresponding small mounting hole, so as to allow the connector to be moveable relative to the panel in either the lengthwise direction or said transverse direction or both;

wherein said recovery means is engageable with a lengthwise side of the periphery of the large mounting opening.

* * * * *